US008770429B2

(12) United States Patent
Stern

(10) Patent No.: US 8,770,429 B2
(45) Date of Patent: Jul. 8, 2014

(54) COFFEE MUG LINER

(76) Inventor: Lance I. Stern, Short Hills, NJ (US)

( * ) Notice: Subject to any disclaimer, the term of this patent is extended or adjusted under 35 U.S.C. 154(b) by 193 days.

(21) Appl. No.: 13/411,671

(22) Filed: Mar. 5, 2012

(65) Prior Publication Data

US 2012/0223079 A1 Sep. 6, 2012

Related U.S. Application Data

(60) Provisional application No. 61/449,250, filed on Mar. 4, 2011, provisional application No. 61/521,088, filed on Aug. 8, 2011.

(51) Int. Cl.
*B65D 25/16* (2006.01)

(52) U.S. Cl.
USPC ..... 220/495.03; 220/703; 220/573.4

(58) Field of Classification Search
USPC ..... 220/495.03, 495.01, 495.11, 573.3, 220/573.4, 703
See application file for complete search history.

(56) References Cited

U.S. PATENT DOCUMENTS

| | | | | |
|---|---|---|---|---|
| 1,955,385 | A * | 4/1934 | Gray | 220/495.11 |
| 2,610,757 | A * | 9/1952 | Irvine | 220/592.24 |
| 4,978,231 | A * | 12/1990 | Ling et al. | 383/11 |
| 5,188,322 | A * | 2/1993 | Kinstrey | 248/146 |
| 5,240,134 | A * | 8/1993 | McDermott et al. | 220/495.03 |
| 5,363,979 | A * | 11/1994 | Thorso | 220/495.11 |
| 6,758,363 | B2 | 7/2004 | Stokes | |
| 8,534,488 | B1 * | 9/2013 | Naum et al. | 220/495.11 |
| 2002/0079316 | A1 * | 6/2002 | Greenfield et al. | 220/573.4 |
| 2004/0055989 | A1 | 3/2004 | Harper et al. | |

FOREIGN PATENT DOCUMENTS

| | | | |
|---|---|---|---|
| CN | 2284019 | Y | 6/1998 |

* cited by examiner

*Primary Examiner* — Stephen Castellano
(74) *Attorney, Agent, or Firm* — Gearhart Law, LLC

(57) ABSTRACT

This disclosure provides a disposable mug liner fitting inside any mug or cup. The mug liner is preferably made of paper impervious to hot or cold liquids and it has a bottom and a wall. The wall is higher than the wall of the cup inside which the liner is inserted. The liner has two downward tearing lines which when torn open allow a formation of a flap that is bent over the mug handle, a hem that is bent down over the mug rim and an aperture to fit the mug handle. The liner according to this invention allows the user to keep the mug clean, protects the user from touching the mug rim and combines the convenience of a disposable cup and the sturdiness and insulation of a regular coffee mug.

8 Claims, 7 Drawing Sheets

COFFEE MUG LINER

PRIORITY

This application claims priority of U.S. provisional application No. 61/449,250 filed on Mar. 4, 2011, and of U.S. provisional application No. 61/521,088 filed on Aug. 8, 2011, and the contents of both of which are incorporated herein by reference in their entirety.

FIELD OF THE INVENTION

The invention relates to cup liners, in particular to disposable cup liners.

BACKGROUND OF THE INVENTION

Disposable cups and mugs are very popular but they do have the disadvantage that they are light and therefore easily knocked over. Moreover, disposable cups may be difficult to hold when the content is hot. Even further disposable cups do not have handle and they may not insulate the contents well.

Many coffee shop customers bring their own cups to be filled at retail outlets. Even if this is environmentally beneficial, it creates the problem of a dirty coffee cup. After having the beverage from their own cup, the customer needs either to wash the cup or to transport a dirty cup back to their home or office. The present invention provides a novel solution to this problem.

U.S. Pat. No. 5,816,501 describes a disposable paint container liner, where a lid is removed from a paint cup and a disposable liner bag is inserted into the cup while an open end of the liner bag extends from the open cup end. The open liner bag end is folded over and protects the cup end and paint is poured into the liner bag. A disposable lid is placed over the open cup end and the open liner bag end is folded inwardly over the disposable lid. The paint cup lid is then attached to the paint cup, clamping the liner bag and disposable lid in place.

U.S. Patent application publication 20100243656 describes a liner insert for a supply bucket of a liquid siphoning system, such as a siphon for an airless paint sprayer. The liner is adapted to simply slide into a bucket that corresponds to its size. The liners preferably are disposable, and may be manufactured, such as from plastic, in various sizes and shapes to accommodate different supply bucket and siphon geometries.

U.S. Pat. No. 3,580,468 describes a double-walled, disposable container that is formed by combining a conventional outer paper cup and an inner liner cup formed of thin-walled thermoformed seamless plastic. The inner liner has a rim or lip at the top which is curled over, around and under the rim of the outer paper cup so as to snugly embrace the same. U.S. Pat. No. 4,134,492 describes a container for a beverage concentrate, where a cup and a plastic film liner positioning the beverage concentrate between the liner and the cup bottom is provided. The liner overlaps the rim of the cup and is attached thereto so as to form a convenient easily handled section enabling the liner to be removed when the beverage concentrate is to be used as by adding water thereto.

U.S. patent application publication 20040055989 that describes a sipping cup for toddlers including a reusable cup portion and securing ring and a disposable top portion and liquid holding bag. The liquid holding bag is inserted into the reusable cup portion, a desired liquid placed in the bag, a disposable top portion is placed over the liquid filled bag, and a reusable top portion is then placed on top and screwed down onto the reusable cup portion. After use, the disposable top portion and liquid holding bag may be discarded while retaining the reusable cup portion and securing ring for future reuse.

U.S. Pat. No. 5,685,480 discloses a disposable insulated drinking cup that includes an inner liner, an outer annular shell, and an air-filled spacer between the liner and shell. The spacer includes a corrugated wall adhered to a backing sheet. Both the corrugated wall and backing sheet are of thin-wall construction to maximize the air volume and insulation properties of the spacer.

U.S. Pat. No. 6,758,363 discloses a portable beverage container that has a body and a liner fitting inside the body. The body has a handle for easy grasping. The material of the body and the liner is dishwasher safe, preferably aluminum, steel or thermoplastic.

U.S. Reissued Pat. No. RE42,421 that describes an insulated cup holder including a double walled insulating vessel including an inner liner and an outer liner spaced defining an insulating space and snugly receives a conventional cup so as to insulate the contents of the cup to assist in maintaining its temperature at a desired level.

Chinese patent application publication CN1996096243569U describes a cup with an internal plastic liner. In this invention the liner and the cup is a unit in the sense that the liner when inserted into the cup is plugged and fixed to notches in the cup body. Therefore, the liner is unsuitable to be used with any other cup.

Accordingly, even if there is a number of various kinds of liners disclosed in the prior art and some of them meant to be used with coffee cups and mugs, there is a remaining need for a disposable mug liner that would be easy to use, and would fit inside any coffee mug.

SUMMARY OF THE INVENTION

It is an object of this invention to provide an inexpensive disposable mug liner that fits into any coffee mug.

It is another object of this invention to provide a mug liner that protects a cup from inside and leaves the cup clean after using.

Yet another object of this invention is to provide a mug liner that protects the user from touching the mug with his/her lips when drinking.

Another object of this invention is to provide a method to reduce unnecessary dishwashing by allowing a user to protect the cup with a liner that leaves the cup clean after a use.

A further object of this invention is to provide a mug liner made of biodegradable material.

Another object of the invention is to provide a kit comprising a mug and a desired number of disposable mug liners.

Yet another object of the invention is to provide a method to keep a mug clean by protecting it with a mug liner.

It is an object of the invention to provide a mug liner fitting inside a mug having a bottom, a side wall, a rim, and a handle; said mug liner comprising a side wall and a bottom, both impervious to liquids in the range of 10 to 150 degrees Celsius; said side wall of the mug liner being taller than the side wall of the mug and said side wall of the mug liner having an upper rim and two substantially vertical tearing lines within a relatively close proximity of each other extending from the upper rim downward, said tearing lines enabling formation of a flap, an aperture and a hem when torn apart, said flap being formed by ripping the wall of the mug liner along the tearing lines downward from the upper rim to selected endpoints of the tearing lines, said selected end points being at same distance from the upper rim and locating on the liner wall at substantially the level a height of the mug rim inside which the liner is placed, and the flap further being bent downward along a short horizontal line between the endpoints and the hem being bent downward along a long horizontal line between the endpoints and the mug handle being placed in the aperture.

DESCRIPTION OF THE PREFERRED EMBODIMENTS

Figure 1:
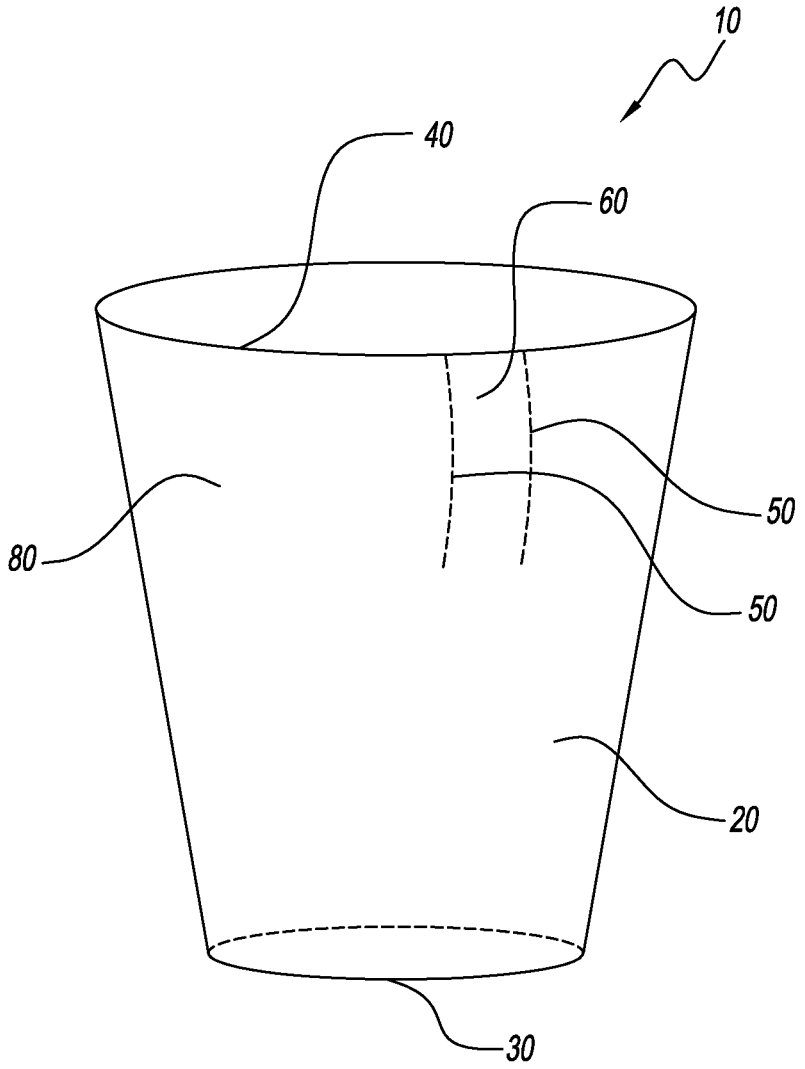
FIG. 1 is a perspective view of the liner according to a preferred embodiment of the invention.

The preferred embodiments of the present invention will now be described with reference to FIG. 1-7 of the drawings. Identical elements in the various figures are identified with the same reference numerals.

Referring now to the drawings and initially to FIG. 1, a preferred embodiment of the mug liner 10 comprises a cylindrical or conical side wall 20, and a bottom 30, said side wall 20 being taller than a mug with which the liner is to be used and the side wall having an upper rim 40, and two substantially vertical tearing lines 50 within a relatively close proximity of each other, said tearing lines extending from the upper rim 40 downward and said tearing lines 50 separating a flap 60 and a hem 80.

Figure 2:
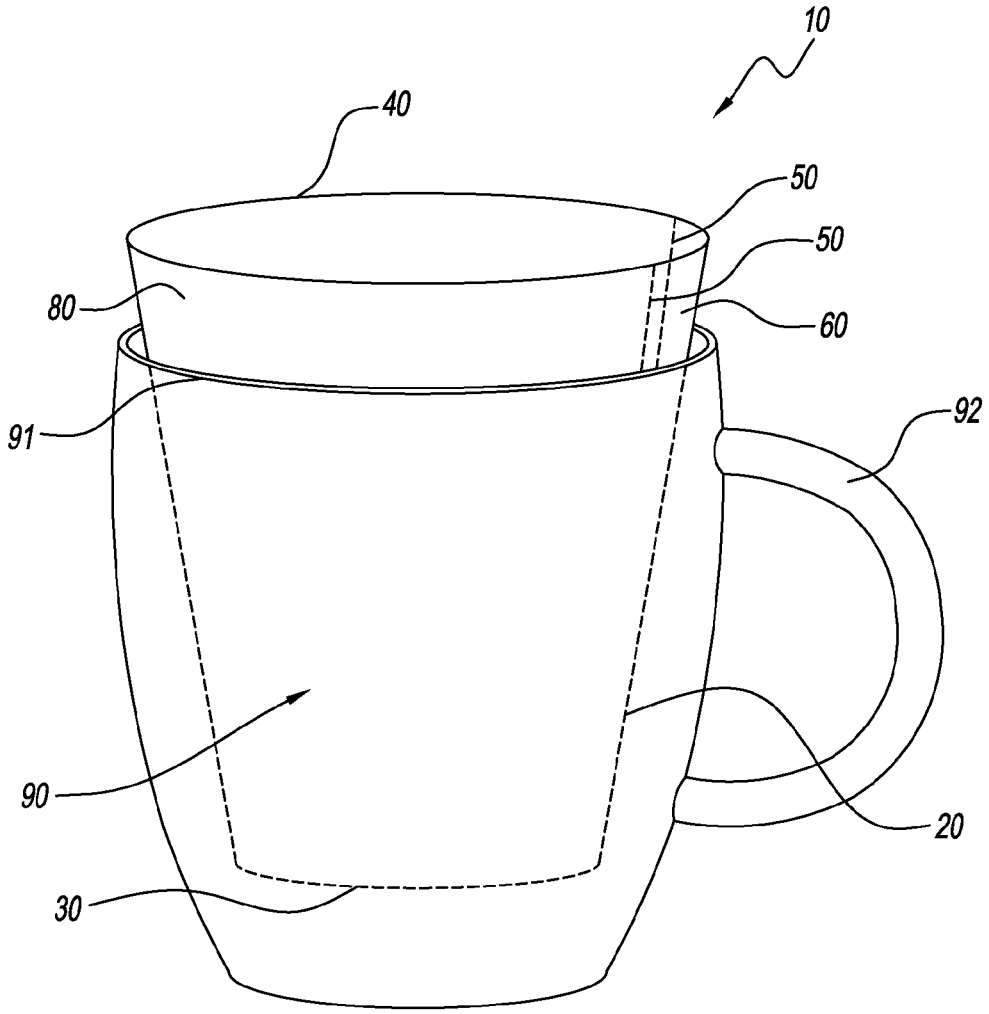
FIG. 2 is a perspective view of the liner according to a preferred embodiment of the invention when inserted in a mug.

Referring now to FIG. 2, according to a preferred embodiment the liner 10 is placed inside a mug 90, said mug having an upper rim 91 and preferably a handle 92. The tearing lines 50 of the liner are aligned with the handle 92.

Figure 3:
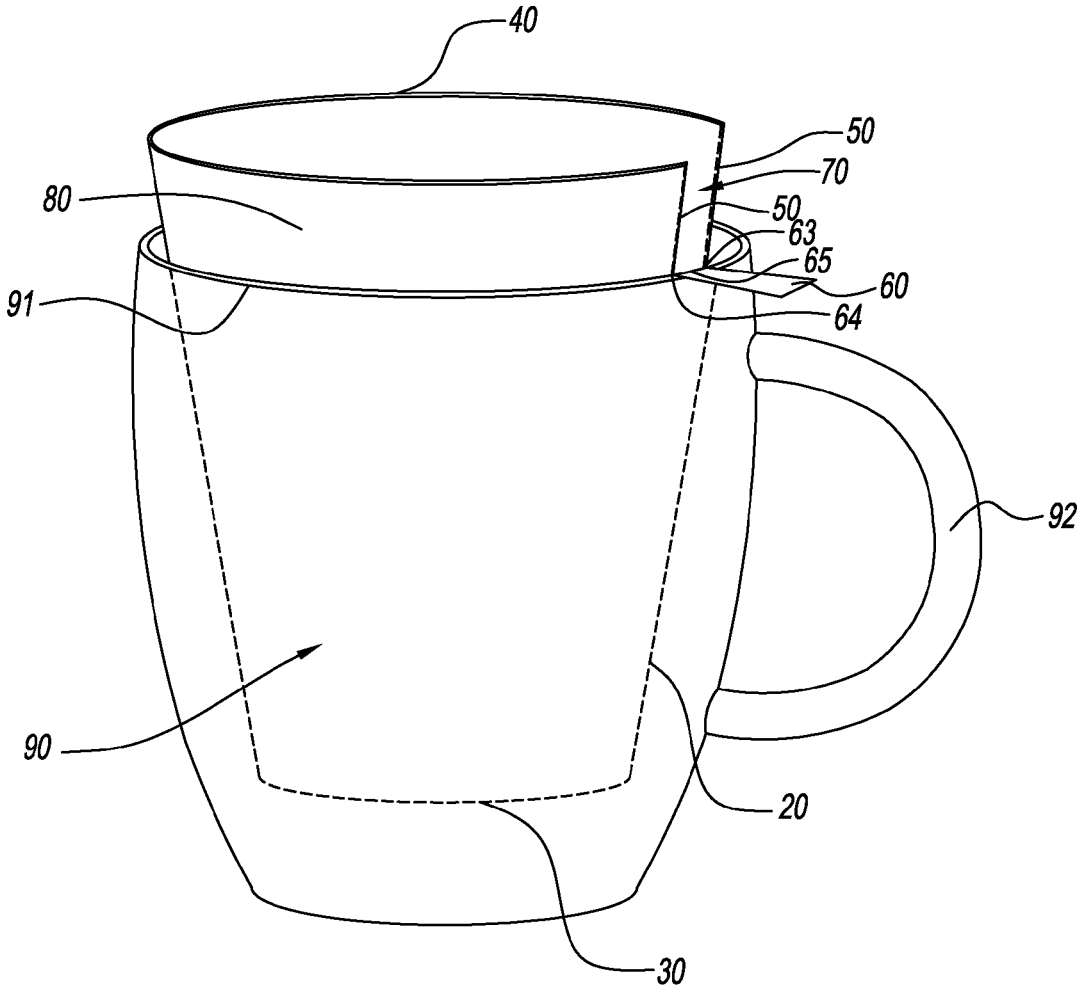
FIG. 3 is a perspective view of the liner according to a preferred embodiment of the invention when inserted in a mug and showing formation of the flap.
Figure 4:
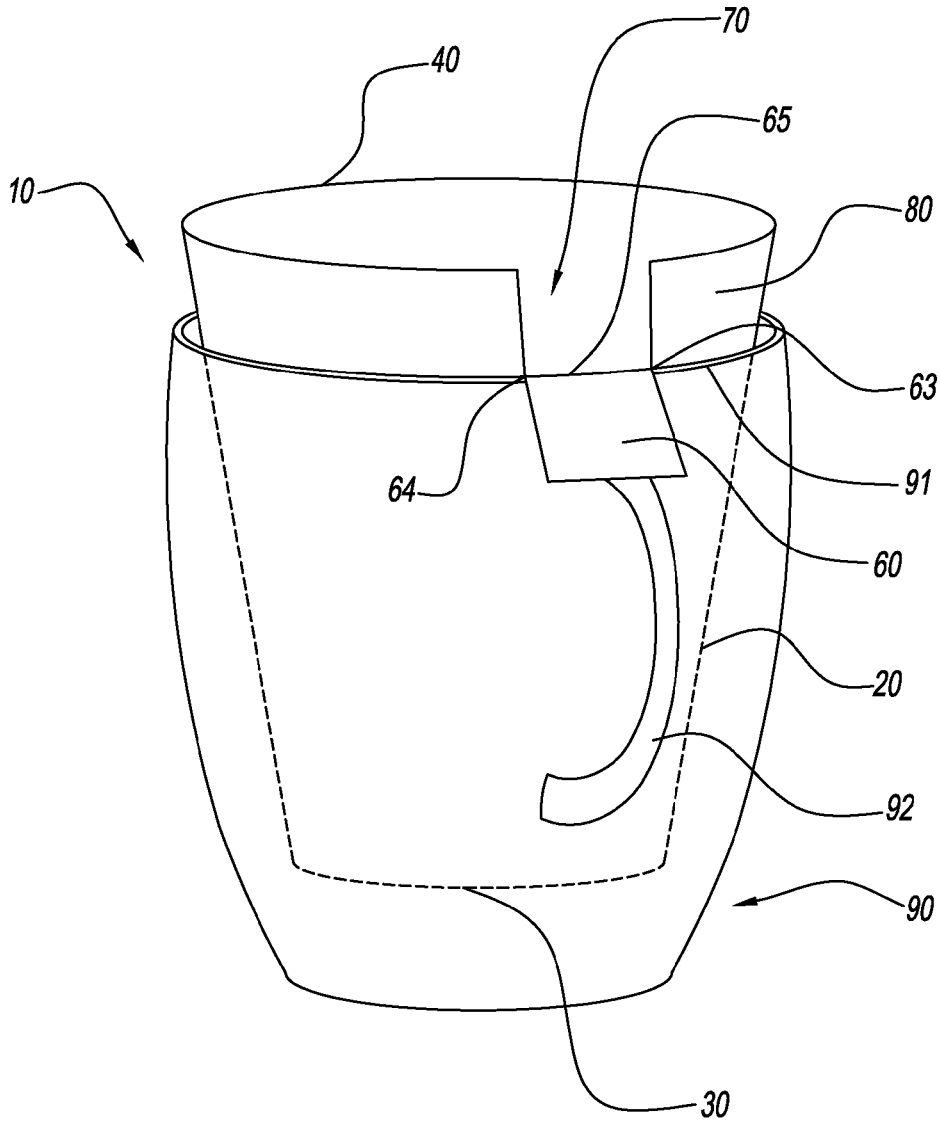
FIG. 4 is another perspective view of the liner according to a preferred embodiment of the invention when inserted in a mug and showing formation of the flap.

Referring now to FIG. 3 and FIG. 4, a flap 60, an aperture 70, and a hem 80 are formed by ripping the wall 20 along the tearing lines 50 downward from the rim 40 to selected endpoints 63, 64 of the tearing lines. The selected end points 63 and 64 are preferably at same distance from the rim 40. The selected end points locate preferably on the liner wall 20 at a height of the rim of the mug 91 inside which the liner is placed. The mug liner fits to any mug as the end points may be selected to be higher on the tearing lines when a taller mug is used and lower on the tearing line when a smaller mug is used.

Figure 5:
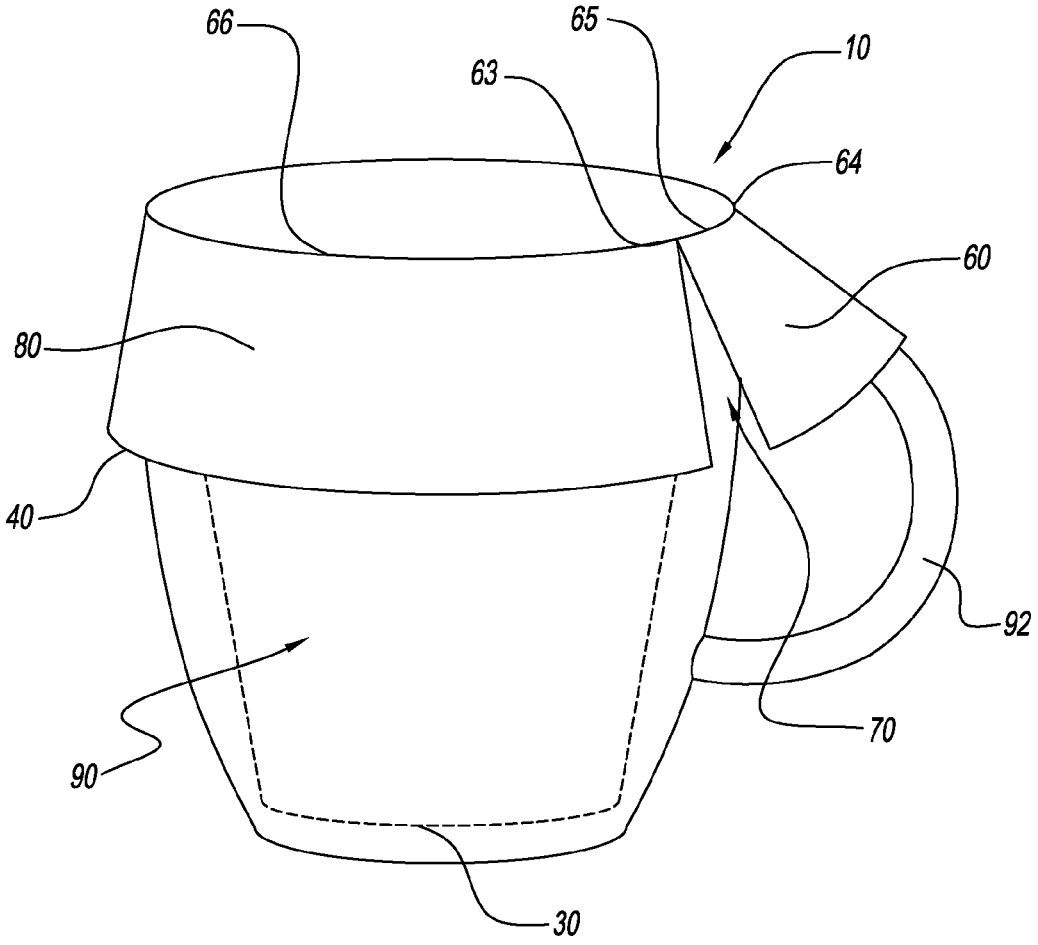
FIG. 5 is a perspective view of the liner according to a preferred embodiment of the invention when inserted in a mug and showing formation of the flap, hem and aperture.
Figure 6:
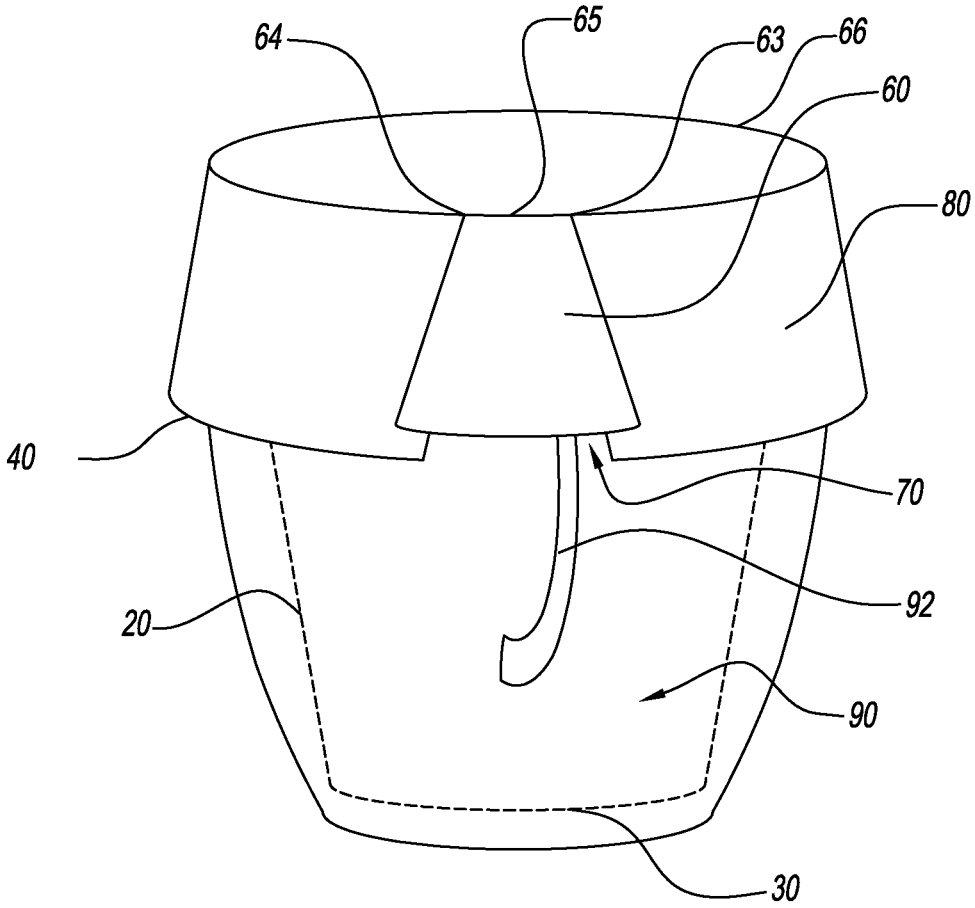
FIG. 6 is another perspective view of the liner according to a preferred embodiment of the invention when inserted in a mug and showing formation of the flap, the hem and the aperture.

Referring now to FIG. 5 and FIG. 6 the flap 60 is bent downward along a short horizontal line 65 between the endpoints 63 and 64. The hem 80 is bent downward over the mug rim 91 along a long horizontal line 66 between the endpoints 63 and 64, and the cup handle 92 being placed in the aperture 70 to stabilize the liner inside the mug 90.

Figure 7:
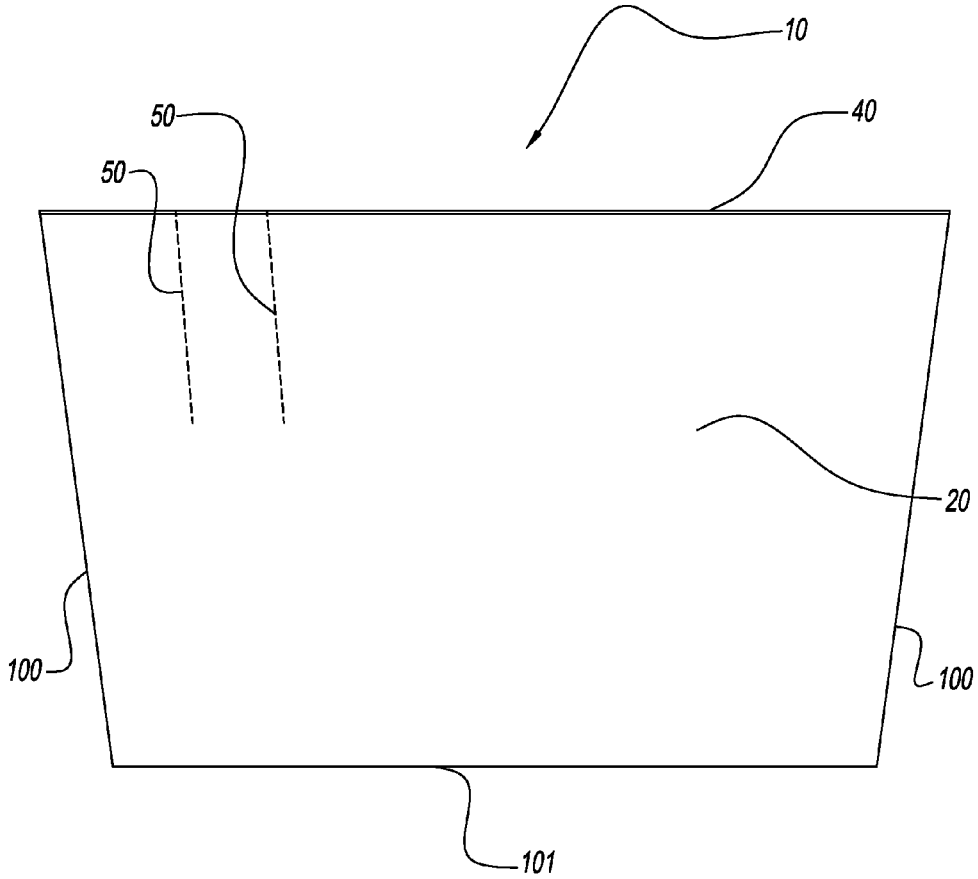
FIG. 7 is a perspective view of the liner according to a preferred embodiment where the liner is flattened before use.

According to one preferred embodiment the liner 10 is conical or cylindrical and may be stored in a flattened form before use. Referring now to FIG. 7, the liner 10 is pressed flat along two vertical seams 100 on the liner wall 20 and a seam along the diameter 101 of the bottom 30.

The mug liner according to this invention is made of disposable material. According to one preferred embodiment the mug liner of this invention is made of biodegradable materials.

According to a preferred embodiment the mug liner is made of flexible material.

According to one preferred embodiment the mug liner is made of paper or cardboard.

According to another embodiment the mug liner is made of plastic. According to one preferred embodiment the mug liner is made of biodegradable plastic. A skilled artisan would realize that the mug liner may be made of various materials as long as the material is thin and flexible enough to allow the hem 80 and the flap 60 to be bent downwards.

According to one preferred embodiment the liner is made of paper and the inner surface of the liner is covered by a thin plastic film or other non sticky material.

Another embodiment of the invention is a kit comprising a mug and a desired number of disposable mug liners.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. A mug liner fitting inside a mug having a bottom, a side wall, a rim, and a handle;

said mug liner comprising a side wall and a bottom, both impervious to liquids in the range of 10 to 150 degrees Celsius;

said side wall of the mug liner being taller than the side wall of the mug and said side wall of the mug liner having an upper rim and two substantially vertical tearing lines within a relatively close proximity of each other extending from the upper rim downward;

said tearing lines enabling formation of a flap, an aperture and a hem when torn apart;

said flap being formed by ripping the wall of the mug liner along the tearing lines downward from the upper rim to selected end points of the tearing lines, said selected end points being at same distance from the upper rim and locating on the liner wall at substantially the level of the mug rim inside which the liner is placed; and the flap further being bent downward along a short horizontal line between the endpoints and the hem being bent downward along a long horizontal line between the endpoints and the mug handle being placed in the aperture.

2. The mug liner and mug of claim 1, wherein the side wall of the mug liner is cylindrical or conical.

3. The mug liner and mug according to claim 1, wherein the liner is made of paper, card board or plastic.

4. The mug liner and mug of claim 3, wherein the liner is made of paper covered with a thin plastic film.

5. The mug liner and mug according to claim 1, wherein the liner is made of biodegradable material.

6. The mug liner and mug of claim 3, wherein the liner may be stored in flattened form before use.

7. A kit comprising the mug liner and mug of claim 1 and a desired number of additional mug liners of claim 1.

8. A method to keep a coffee mug clean, said method comprising the steps of:

a. fitting the liner of claim 1 on the mug of claim 1;

b. filling the mug with preferred beverage;

c. consuming the beverage; and d. discarding the liner.

* * * * *